US011121499B2

(12) United States Patent
Trigg

(10) Patent No.: US 11,121,499 B2
(45) Date of Patent: Sep. 14, 2021

(54) COVER SYSTEM AND METHOD

(71) Applicant: JAGUAR LAND ROVER LIMITED, Coventry (GB)

(72) Inventor: Robert Trigg, Warwickshire (GB)

(73) Assignee: Jaguar Land Rover Limited, Coventry (GB)

( * ) Notice: Subject to any disclaimer, the term of this patent is extended or adjusted under 35 U.S.C. 154(b) by 140 days.

(21) Appl. No.: 16/495,172

(22) PCT Filed: Mar. 30, 2018

(86) PCT No.: PCT/EP2018/058312
§ 371 (c)(1),
(2) Date: Sep. 18, 2019

(87) PCT Pub. No.: WO2018/192767
PCT Pub. Date: Oct. 25, 2018

(65) Prior Publication Data

US 2021/0194175 A1 Jun. 24, 2021

(30) Foreign Application Priority Data

Apr. 19, 2017 (GB) ..... 1706195

(51) Int. Cl.
*H01R 13/44* (2006.01)
*H01R 13/52* (2006.01)
(Continued)

(52) U.S. Cl.
CPC ..... *H01R 13/5213* (2013.01); *H01R 13/443* (2013.01); *H01R 13/5202* (2013.01); *H01R 31/08* (2013.01)

(58) Field of Classification Search
CPC ..... H01R 13/5202; H01R 13/5213; H01R 13/443; H01R 31/08
(Continued)

(56) References Cited

U.S. PATENT DOCUMENTS 2,428,323 A * 9/1947 Winer ..... H01R 13/443 174/77 R
5,393,242 A * 2/1995 VanDerStuyf ..... H01R 13/514 439/271
(Continued)

FOREIGN PATENT DOCUMENTS

DE 3019599 3/1919
DE 20204675 8/2002
(Continued)

OTHER PUBLICATIONS

Search and Examination Report, GB1706195.3, dated Oct. 20, 2017, 12 pages.
(Continued)

*Primary Examiner* — Abdullah A Riyami
*Assistant Examiner* — Vladimir Imas
(74) *Attorney, Agent, or Firm* — McCoy Russell LLP

(57) ABSTRACT

Embodiments of the present invention provide a cover system (300) for at least temporarily preventing access to one or more terminals (402, 404) of an electrical connector (400). The system (300) comprises a first cover part (100) and a second cover part (200). The first cover part (100) comprises sealing means (104) for sealing the first cover part (100) about the one or more terminals (402, 404) of the electrical connector (400). The first cover part also comprises a member (106) comprising an aperture (118) for receiving a locking means. The second cover part (200) is receivable about at least a portion of the first cover part (100) and at least part of the electrical connector (400). The second cover part (200) comprises engaging means (204) for engaging with the electrical connector (400) to at least partially retain the second cover part (200) about the first cover part (100) and at least part of the electrical connector (400). The second cover part (200) also comprises an opening (202) for receiving the member (106) of the first cover part (100). The
(Continued)

aperture (106) of the first cover part (100) is arranged such that when the cover system (300) is assembled with the electrical connector (400) and a locking means is received by said aperture (118), disengagement of the engaging means (204) from the electrical connector (400) is substantially prevented. Embodiments of the invention also relate to a method for at least temporarily preventing access to one or more terminals (402, 404) of an electrical connector (400).

20 Claims, 3 Drawing Sheets

(51) Int. Cl.
*H01R 31/08* (2006.01)
*H01R 13/443* (2006.01)

(58) Field of Classification Search
USPC ..... 439/148
See application file for complete search history.

(56) References Cited

U.S. PATENT DOCUMENTS 5,551,892 A * 9/1996 Endo ..... H01R 13/443 439/587
5,605,467 A * 2/1997 Beck ..... H01R 13/447 439/148
6,309,247 B1 * 10/2001 Wang ..... H01R 13/5213 439/135
6,699,050 B1 * 3/2004 Wong ..... H01R 13/443 174/67
6,740,812 B2 * 5/2004 DeWitt ..... H02G 3/0468 16/2.1
6,761,590 B2 * 7/2004 Maue ..... G01N 27/4062 439/620.15
7,150,638 B1 12/2006 Fonville et al.
7,428,834 B1 * 9/2008 Lee ..... E05B 67/36 439/133
7,462,045 B1 * 12/2008 Lee ..... H01R 13/443 439/133
7,465,185 B2 * 12/2008 Tyler ..... H01R 13/506 439/352
7,563,113 B2 * 7/2009 Sheng ..... H01R 13/5213 439/135
7,753,728 B2 * 7/2010 Ikeya ..... H01R 13/5205 439/587
7,914,309 B2 * 3/2011 Chazottes ..... H01R 13/5213 439/275
8,105,097 B2 * 1/2012 Thijs ..... H01R 31/08 439/148
8,591,239 B2 * 11/2013 Dai ..... H04R 25/556 439/133
9,071,006 B2 * 6/2015 Ohhashi ..... H01R 13/5213
9,088,091 B2 * 7/2015 Suzuki ..... H01R 13/447
9,293,878 B2 * 3/2016 Tashiro ..... B60R 16/027
9,601,865 B2 * 3/2017 Berengut ..... H01R 13/5221
9,941,636 B2 * 4/2018 Jodon De Villeroche ..... H01R 13/641
10,074,926 B2 * 9/2018 Rui ..... H01R 13/5205
10,141,673 B2 * 11/2018 Norton ..... H04L 12/6418
10,811,812 B2 * 10/2020 Miyazawa ..... H01R 13/4367
2003/0029581 A1 2/2003 Vide
2010/0071977 A1 3/2010 Ritz et al.
2011/0021064 A1 * 1/2011 Shibata ..... H01R 13/5812 439/470
2012/0222833 A1 9/2012 Vikstrom et al.
2015/0140850 A1 * 5/2015 Suzuki ..... H01R 9/0524 439/275
2020/0321723 A1 * 10/2020 Takagi ..... H01R 13/6581
2021/0111508 A1 * 4/2021 Gu ..... H01R 13/502

FOREIGN PATENT DOCUMENTS

EP 1006380 6/2000
JP 2015115129 6/2015
WO 2016192984 12/2016

OTHER PUBLICATIONS

International Search Report and Written Opinion, PCT/EP2018/058312, dated May 29, 2018, 12 pages.

* cited by examiner

COVER SYSTEM AND METHOD

CROSS-REFERENCE TO RELATED APPLICATIONS

This application is a 371 of International Application No. PCT/EP2018/058312, filed Mar. 30, 2018, which claims priority to GB Patent Application 1706195.3, filed Apr. 19, 2017, the contents of both of which are incorporated by reference herein in their entirety.

TECHNICAL FIELD

The present disclosure relates to a cover system and particularly, but not exclusively, to a cover system for at least partially preventing access to a terminal of an electrical connector.

Aspects of the invention relate to a system, to components of the system and to a method.

BACKGROUND

It is often desired to prevent access to electrical connectors during operations carried out on an electrical system with which the connector is associated. Indeed, during some operations, it is a requirement that electrical connectors be covered. This may be particularly applicable where the electrical system is operable at a high voltage. The electrical connector may, although not exclusively, be associated with a battery pack of the electrical system. In this case, such operations requiring electrical connectors to be covered may include at least servicing the battery pack, storing the battery pack and transporting the battery pack. Access to a terminal of the electrical connector must be temporarily prevented throughout such operations. Ideally, ingress of materials, such as dust and water, to the electrical connector should also be prevented.

One prior art solution for covering an electrical connector is a flexible cap, which may be made from an elastomer material such as silicone. The cap is arranged to be fitted over the electrical connector. The cap is dimensioned such that, in use, it forms a relatively close fit over the electrical connector. Although the cap may provide some protection against ingress of materials into the electrical connector, such as dust, it may not completely seal off the connector and cannot be locked in place over the connector, for example to prevent unintentional removal during an operation.

Another prior art cover comprises a two part clamping arrangement. One of the parts is fitted over a top part of the electrical connector and the other of the two parts is fitted over a bottom part of the electrical connecter. The two parts clamp together in a sliding fit, via corresponding lips and grooves, thereby enclosing the connector between the two parts. Whilst this arrangement may be locked, due to its relatively loose fit to enable the sliding connection, it is unable to prevent ingress of materials such as dust and water and may not provide a lock that is secure enough to completely prevent access to the connector. Furthermore, the shape of the two part arrangement is relatively bulky when assembled and may be difficult to mould.

At least in certain embodiments, the present invention seeks to overcome or ameliorate at least some of the shortcomings of prior art arrangements.

SUMMARY OF THE INVENTION

Aspects and embodiments of the invention provide a system, components of the system and a method, as claimed in the appended claims.

According to an aspect of the invention, there is provided a cover system for at least temporarily preventing access to one or more terminals of an electrical connector, the system comprising:

- a first cover part comprising means for sealing around the one or more terminals of the connector; and
- a second cover part comprising means for at least temporarily locking the first cover part to the connector.

In an embodiment, said means for sealing may comprise a seal, such as an O-ring seal or a labyrinth seal. In another embodiment, said means for at least temporarily locking may comprise an open ended slot engageable with a lug on the electrical connector.

Advantageously, the cover system is able to provide a sealing function, to prevent ingression of material such as dust and water, whilst also providing a locking function, for, at least temporarily, preventing access to a terminal of the connector.

According to an aspect of the invention, there is provided a cover system for at least temporarily preventing access to one or more terminals of an electrical connector, the system comprising:

- a first cover part receivable by the connector along a first axis; and
- a second cover part receivable by the connector along a second axis,
- wherein the first axis and the second axis are substantially orthogonal,
- and wherein the first cover part and the second cover part are arranged to interlock about the connector.

Advantageously, the cover system is able to provide an improved locking function, to at least temporarily, prevent access to a terminal of the connector.

According to an aspect of the invention, there is provided a cover for at least temporarily preventing access to one or more terminals of an electrical connector, wherein at least a portion of the cover is receivable within the connector and wherein the cover comprises means for sealing said portion to the connector to at least temporarily, prevent access to the terminal of the connector.

Advantageously the cover system is able to provide an improved sealing function, to prevent ingression of material such as dust and water.

In an embodiment, said means for sealing may comprise a seal, such as an O-ring seal or a labyrinth seal.

According to an aspect of the invention, there is provided a cover system for at least temporarily preventing access to one or more terminals of an electrical connector, the system comprising:

- a first cover part comprising:
  - sealing means for sealing the first cover part about the one or more terminals of the electrical connector; and
  - a member comprising an aperture for receiving a locking means; and
- a second cover part receivable about at least a portion of the first cover part and at least part of the electrical connector, the second cover part comprising:
  - engaging means for engaging with the electrical connector to at least partially retain the second cover part about the first cover part and at least part of the electrical connector; and
  - an opening for receiving the member of the first cover part,
- wherein the aperture is arranged such that when the cover system is assembled with the electrical connector and a locking means is received by said aperture, disengagement of the engaging means from the electrical connector is substantially prevented.

Advantageously, the cover system is able to provide a sealing function, to prevent ingression of material such as dust and water, whilst also providing a locking function, for, at least temporarily, preventing access to a terminal of the electrical connector.

In an embodiment, the sealing means may comprise a seal, such as an O-ring seal or a labyrinth seal and the locking means may comprise a lock such as a padlock or cable tie.

In an embodiment, the aperture is arranged on the member and the engaging means are arranged on the second cover part such that when the first cover part and the second cover part are fitted to the electrical connector, an aperture axis through the aperture is substantially orthogonal to an axis or axes of the engaging means. Advantageously, providing the aperture and the engaging means on substantially orthogonal axes contributes to a mutual locking of the cover system, thereby contributing to an improved the locking function.

In an embodiment, the aperture is arranged on the member and the engaging means is arranged on the second cover part, such that a distance along the member where aperture is located is of a shorter length than a length over which the engaging means may maintain engagement with the electrical connector. Advantageously, this arrangement contributes to an improved locking function of the cover system.

In an embodiment, the first cover part is at least partially receivable about at least one of the one or more terminals of the electrical connector along a longitudinal axis of the electrical connector. This advantageously improves alignment of the first cover part with the electrical connector, thereby providing improved sealing between the first cover part and the electrical connector.

Optionally, the second cover part is receivable about at least a portion of the first cover part and at least part of the electrical connector along an axis substantially perpendicular to the longitudinal axis of the electrical connector. Advantageously, this improves alignment of the second cover part with the first cover part and the electrical connector, thereby providing improved locking of the cover system.

In an embodiment, said engaging means comprises a first open ended slot correspondingly shaped to engage with a first lug on the electrical connector. Advantageously, this provides a complementary relationship between the engaging means and the electrical connector, leading to improved locking of the cover system. An open ended slot may be elongated, to provide a relatively long distance over which the engaging means may maintain engagement with the lug on the electrical connector.

Optionally, the engaging means comprises a second open ended slot correspondingly shaped to engage with a second lug on the electrical connector, wherein the first and second lugs on the electrical connector are arranged at opposing sides of the electrical connector. Advantageously, this provides a symmetrical engagement of the second cover part with the electrical connector, thereby providing a more stable locking arrangement.

In an embodiment, said open ended slot or slots are each defined by a pair of legs depending from a main body portion of the second cover part. The legs may be elongated, to provide a relatively long distance over which the engaging means may maintain engagement with the lug on the electrical connector.

In an embodiment, the engaging means is engageable with the electrical connector by a snap fit mechanism. This advantageously provides easier assembly and disassembly of the cover system.

In an embodiment, the first cover part comprises a body portion, which body portion is at least partially insertable within a female portion of the electrical connector. Advantageously, this provides a stable engagement between the first cover part and the electrical connector.

Optionally, the first cover part comprises at least one stop for preventing over insertion of the body portion within the female portion of the electrical connector. The stop may comprise one or more ledges. The one or more ledges may be provided on the body portion and may correspond to grooves on the electrical connector. Advantageously, this helps to provide appropriate engagement and therefore sealing between the electrical connector and the first cover part.

In an embodiment, the first cover part comprises at least one locating feature for at least partially aiding alignment of the first cover part with electrical connector. The at least one locating feature may comprise a guide rail or rails on the first cover part. The at least one locating feature may be arranged to correspond to a feature on the electrical connector. The feature on the electrical connector may be a recess or recesses on electrical connector. The one or more locating feature may be arranged to engage with the feature on the electrical connector. Advantageously, this helps to provide appropriate engagement and therefore sealing between the electrical connector and the first cover part.

In an embodiment, the second cover part comprises at least one locating feature for at least partially aiding alignment of the second cover part about the first cover part and the electrical connector. The at least one locating feature may comprise a recess or detent on the second cover part. The at least one locating feature may be arranged to correspond to a feature on the electrical connector. The feature on the electrical connector may be a protrusion on electrical connector. The one or more locating feature may be arranged to engage with the feature on the electrical connector. Advantageously, this helps to provide appropriate engagement between the electrical connector and the second cover part.

In an embodiment, the sealing means is arranged to seal against an internal surface of the female portion of the electrical connector. In some embodiments, this is achieved by providing the sealing means at least on an external surface of the first cover part.

In an embodiment, the sealing means is additionally or alternatively arranged to seal about the, or each of the, individual terminals of the electrical connector. In some embodiments, this may be achieved by providing the sealing means within an internal cavity of the first cover part.

In an embodiment, the sealing means may be arranged to form a seal with an internal end face of the female portion of the electrical connector.

In an embodiment, the sealing means comprises at least one O-ring.

In an embodiment, the sealing means comprises at least one labyrinth seal.

According to an aspect of the invention, there is provided a cover system for at least temporarily preventing access to one or more terminals of an electrical connector, the system comprising:

a first cover part comprising:

a seal for sealing the first cover part about the one or more terminals of the electrical connector; and a member comprising an aperture for receiving a padlock; and a second cover part receivable about at least a portion of the first cover part and at least part of the electrical connector, the second cover part comprising:

an open ended slot for engaging with a feature of the electrical connector to at least partially retain the second cover part about the first cover part and at least part of the electrical connector; and an opening for receiving the member of the first cover part, wherein the aperture is arranged such that when the cover system is assembled with the electrical connector and a padlock is received by said aperture, disengagement of the open ended slot from the electrical connector is substantially prevented.

Advantageously, the cover system is able to provide a sealing function, to prevent ingression of material such as dust and water, whilst also providing a locking function, for, at least temporarily, preventing access to a terminal of the electrical connector.

In an embodiment, the cover system may be provided with a wedge clip feature, enabling the first and second cover parts to lock gently together.

In an embodiment, the cover system comprises means for allowing activation of a voltage interlock loop, such as a voltage interlock loop (VIL) of the electrical connector when at least the first cover part of the cover system is fitted to the electrical connector. The means for allowing activation of the VIL may be provided by the first cover part. The means may comprise an internal connection in the first cover part, such as on an internal surface of the end face, for bridging a connection between the terminals of the electrical connector.

Advantageously, the means for allowing VIL activation while at least the first cover part of the cover system is fitted to the electrical connector enables diagnostic checks to be run whilst the terminals are sealed off by said sealing means of the first cover part.

In an embodiment, the second cover part may be arranged to fit over a top side of the electrical connector. The electrical connector may be arranged so as to prevent the second cover part from being fitted upside down on the electrical connector, that is, from fitting over the underside of the electrical connector. The electrical connector may comprise a locating feature to prevent to prevent the second cover part from being fitted upside down on the connector. The locating feature may be the same feature with which the engaging means of the second cover part is arranged to engage. The feature may be offset in a horizontal plane to indicate to a user a correct orientation for the second cover part.

The electrical connector may comprise a socket key on an underside of the electrical connector. Advantageously when the cover system is fitted to the electrical connector the socket key remains uncovered, thereby allowing use of the cover system with any keyed socket.

According to another aspect of the invention, there is provided a first cover part for use in as system as above described.

According to another aspect of the invention, there is provided a second cover part for use in a system as above described.

According to yet another aspect of the invention, there is provided a method of at least temporarily preventing access to one or more terminals of an electrical connector, the method comprising:

sealing a first cover part about the one or more terminals of the electrical connector;

positioning a second cover part over the first cover part so that a member portion of the first cover part is received through an opening of the second cover part;

moving the second cover part over at least a portion of the first cover part after the first cover part has been sealed to the one or more terminals of the electrical connector; and engaging an engaging means of the second cover part with the electrical connector to at least partially retain the second cover part about at least a portion of the first cover part and at least part of the electrical connector, wherein the member portion comprises an aperture for receiving a locking means, and wherein the aperture is arranged such that when the first and second cover parts are assembled with the electrical connector and a locking means is received by said aperture, disengagement of the engaging means from the electrical connector is substantially prevented.

Advantageously the method is able to both prevent ingression of material such as dust and water, whilst also at least temporarily, preventing access to a terminal of the electrical connector.

In an embodiment, the engaging means may comprise an open ended slot correspondingly shaped to engage with a first lug on the electrical connector. The locking means may comprise a lock such as a padlock or cable tie.

In an embodiment, the method comprises translating said first cover part about the one or more terminals of the electrical connector along a longitudinal axis of the electrical connector. This advantageously improves alignment of the first cover part with the electrical connector, thereby providing improved sealing between the first cover part and the electrical connector. The first cover part may be translated about the one or more terminals of the electrical connector along a longitudinal axis of the electrical connector prior to engaging the engaging means of the second cover part with the electrical connector.

In an embodiment, the method comprises moving the second cover part along an axis substantially orthogonal to the longitudinal axis of the electrical connector. Advantageously, this improves alignment of the second cover part with the first cover part and the electrical connector, thereby providing improved locking of the cover system.

In an embodiment, the method comprises inserting a body portion of a first cover part at least partially within a female portion of the electrical connector. Advantageously, this provides a stable engagement between the first cover part and the electrical connector.

In an embodiment, the method comprises applying locking means through the aperture in the member. Advantageously, this enables the first cover part and the second cover part to be locked into position when fitted to the electrical connector.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described by way of example only, with reference to the accompanying drawings, in which.

DETAILED DESCRIPTION

Figure 4:
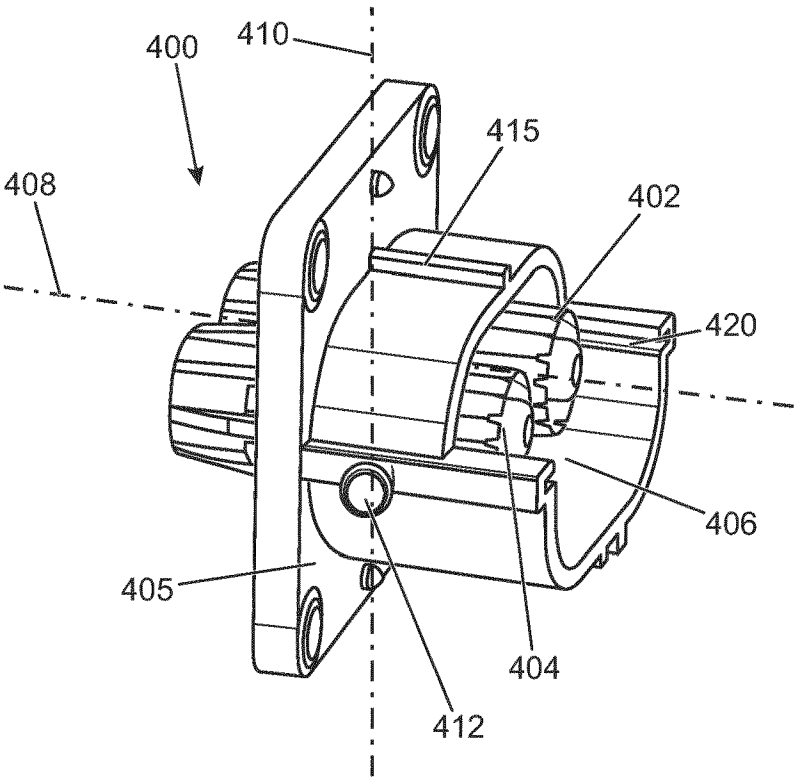
FIG. 4 shows an electrical connector.
Figure 3:
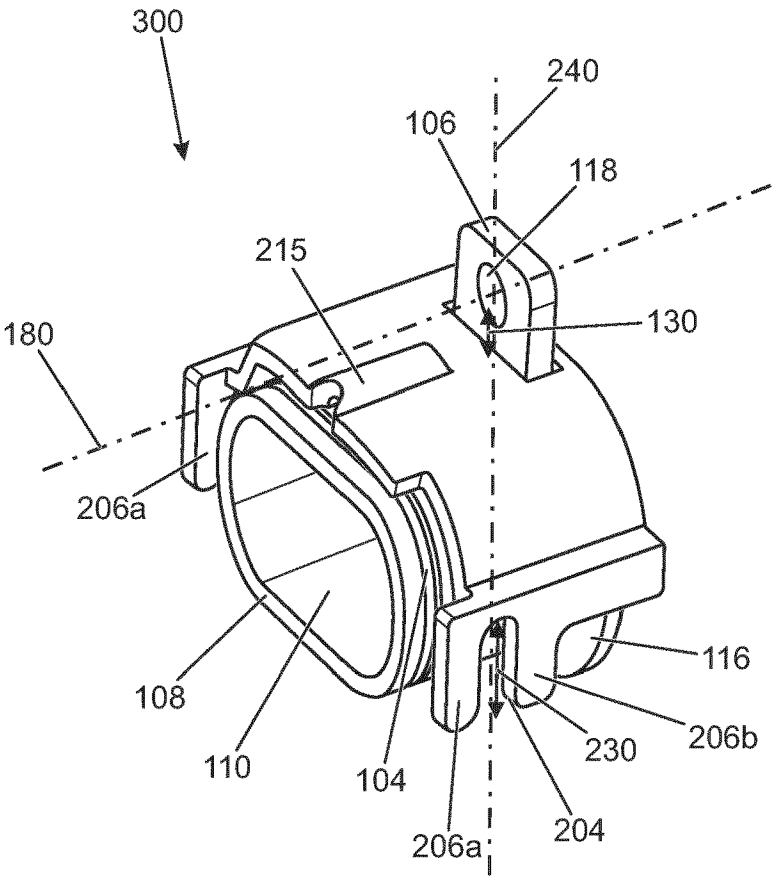
FIG. 3 shows the first cover part of FIG. 1 and the second cover part of FIG. 2 assembled together, according to an embodiment of the invention.

Embodiments of the present invention provide a cover system for at least temporarily preventing access to a terminal of an electrical connector, such as an electrical connector associated with a high voltage electrical system. In the automotive field, a high voltage system may comprise a system involving voltages of at least 48 Volts. The electrical connector may be a connector 400 as shown in FIG. 4. FIG. 4 shows a general electrical connector 400, with some parts not shown, for clarity purposes. The connector 400 comprises a plurality of terminals, such as two terminals 402, 404, a planar face 405 and a female portion 406, which female portion 406 functions as a socket.

With reference to the Figures, a cover system 300 for at least temporarily preventing access to a terminal of an electrical connector, such as the connector 400 shown in FIG. 4, comprises a first cover part 100 and a second cover part 200. The first and second cover parts 100, 200 may be arranged to interlock onto the connector 400.

Figure 1:
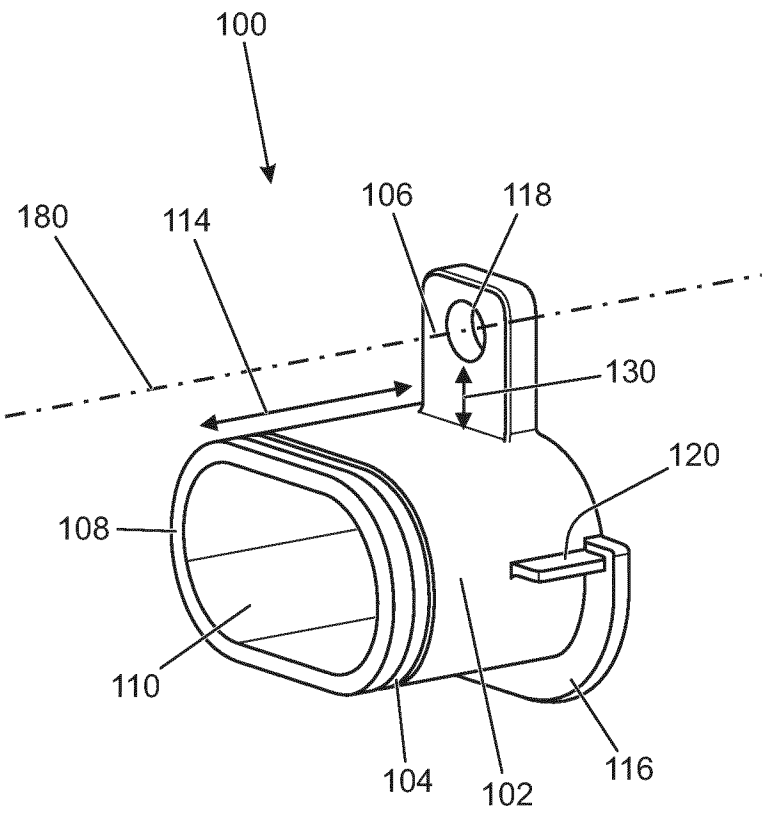
FIG. 1 shows a first cover part according to an embodiment of the invention.

FIG. 1 shows a first cover part 100 for a cover system 300 according to embodiments of the present invention. The first cover part 100 comprises at least one sealing means 104 and a member 106. The first cover part 100 may also comprise a body portion 102. The member 106 may project outward from the body portion 102, such as being upstanding from the body portion 102. In some embodiments, such as the embodiment illustrated in FIG. 1, the body portion 102 comprises a mouth 108 leading to a cavity 110. The cavity 110 may be a blind cavity 110. The mouth 108 and cavity 110 are dimensioned to accommodate receipt of a terminal or terminals 402, 404 of connector 400 within the cavity 110.

In some embodiments, the body portion 102 may be arranged to be at least partially insertable into a female portion of the connector 400 of FIG. 4, such as the socket 406. In some embodiments, the body portion 102 of the first cover part 100 is at least partially insertable in the female portion 406 of the connector 400 along a longitudinal axis 408 of the connector 400. The body portion 102 may have a length 114 that is equal to or less than a length of the female portion 406 of the connector 400 in the longitudinal axis 408. This allows full insertion of the body portion 102 into the female portion 406. The first cover part 100 may include a stop 116 which may comprise a collar that extends beyond a transverse profile or footprint of the body portion 102 of the first cover part 100, such as shown in the embodiments illustrated in FIGS. 1, 3 and 5A to 5D. That is, the stop 116 may outwardly extend from an outer periphery of the body portion 102. The stop 116 is arranged to, in use, abut against an end of the connector 400 to prevent over insertion of the first cover part 100 into the female portion 406 of the connector 400.

The sealing means 104 is arranged to provide a seal between the first cover part 100 and the connector 400 to prevent ingress of material, such as dust or water, into the connector 400. The sealing means 104 may be provided on an external surface of the first cover part 100, such as on the body portion 102, and arranged to seal against an internal surface of the female portion 406 of the connector 400, thereby sealing off the one or more terminals 402, 404 of the connector 400 within the body portion 102. The sealing means 104 may comprise at least one of a labyrinth seal and one or more O-rings. Each O-ring may be accommodated in a groove around the external surface of the body portion 102.

The sealing means 104 may additionally or alternatively be provided within a cavity, such as within the cavity 110 of the body portion 102, and may be arranged to seal about the terminal or terminals 402, 404 of the connector 400. Where the connector 400 comprises more than one terminal 402, 404, the sealing means 104 may be arranged to seal about each individual terminal 402, 404 or about all of the terminals 402, 404 together. The sealing means 104 may be arranged to fit over both the terminal(s) 402, 404 and the female portion 406 of the connector 400. The sealing means 104 may comprise at least one of a labyrinth seal and one or more O-rings.

The sealing means 104 may, in some embodiments, additionally or alternatively be provided on an end of the body part 102, such as at the mouth 108 of the cavity 110. Such sealing means 104 may be arranged to form a seal with an internal end face of the female portion 406 of the connector 400, thereby sealing off the one or more terminals 402, 404 of the connector 400. The sealing means may comprise at least one of a labyrinth seal and one or more O-rings.

In the embodiment illustrated in FIGS. 1, 3 and 5A to 5D, the sealing means 104 comprises at least one O-ring received in a respective annular groove 112 on an external surface at a rear end of the body portion 102. By rear end it is understood to be that end of the body portion 102 which is inserted furthest-most into the connector 400. The body portion 102 may be dimensioned to provide, in use, a close sliding fit within the female portion 406 of the connector 400 such that the O-ring abuts an internal surface of the female portion 406 of the connector 400, thereby forming a seal.

The member 106 of the first cover part 100 comprises means for receiving a locking means (not shown). In some embodiments, such as the embodiment illustrated by FIGS. 1, 3 and 5A to 5D, the means for receiving a locking means is an aperture 118, such as a through hole. As illustrated in the Figures, the aperture 118 may lie along an aperture axis 180. The aperture 118 may be arranged on the member 106 such that when the first cover part 100 is engaged with the electrical connector 400, the aperture axis 180 is substantially parallel to the longitudinal axis 408 of the connector 400. The locking means may comprise, for example, a padlock or a cable tie.

The first cover part 100 may comprise one or more locating means or features for guiding insertion of the body portion 102 into the female portion 406 of the connector 400. With reference to FIG. 1, the locating means may comprise one or more guide rails or flanges 120. The one or more rails or flanges may be shaped to complement a corresponding one or more grooves 420 in the female portion 406 of the connector 400. The one or more guide rails or flanges 120 may be linear to direct movement of the body portion along a linear axis. The one or more guide rails or flanges 120 may be arranged parallel to the longitudinal axis 408 of the connector 400. The one or more guide rails or flanges 120 may extend outward from the body portion 120, such as arranged at one or more sides thereof.

Figure 2:
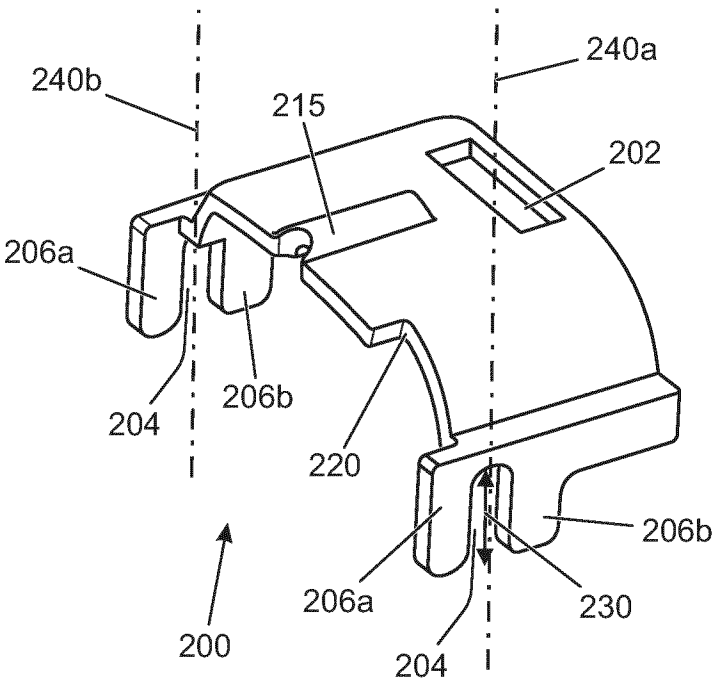
FIG. 2 shows a second cover part according to an embodiment of the invention.

FIG. 2 shows a second cover 200 part for a cover system 300 according to embodiments of the present invention. The second cover part 200 is receivable over the first cover part 100. In an embodiment, the second cover part 200 is receivable over the first cover part 100 when the first cover part 100 is associated with the electrical connector 400. The second cover part 200 is receivable over the first cover part 100 when the first cover part 100 is sealed to the connector 400. In some embodiments, the second cover part 200 is receivable about the first cover part 100 and connector 400 along an axis 410, which axis is substantially perpendicular to the aperture axis 180 and to the longitudinal axis 408 of the electrical connector 400. When so received, the second cover part 200 is arranged to prevent movement of the first cover part 100 along the longitudinal axis 480.

The second cover part 200 comprises an opening 202, for receiving the member 106 of the first cover part 100, and engaging means 204, for engaging one or more features 412 of the connector 400.

In some embodiments, the engaging means 204 comprises at least one open ended slot 204 correspondingly shaped to engage with a respective feature 412, which may be a lug, of the electrical connector 400. The respective one or more lugs of the connector 400 may outwardly extend from the connector 400. The at least one open ended slot 204 may be arranged along a slot axis 240, which slot axis is arranged to be, in use, substantially perpendicular to said aperture axis 180 of the aperture 118 and said longitudinal axis 408 of the connector 400. The slot axis 240 may be substantially parallel to the axis 410. Each open ended slot 204 may be defined by a pair of legs 206*a*, 206*b*, which legs may depend from a main body portion of the second cover part 200. The engaging means 204 may be engageable with the feature 412 by a snap fit mechanism. In some embodiments, such as the embodiments of FIGS. 2, 3 and 5A to 5D, the second cover part 200 may comprise two opposed engaging means 204. The two opposed engaging means 204 may be arranged to engage corresponding features 412 of the connector 400, the features 412 opposed about the female portion 406 of the connector 400. The two opposed engaging means 204 may be each arranged along their own respective slot axes 240*a*, 240*b*, which slot axes are substantially parallel. The slot axes 240*a*, 240*b* may be arranged so as to be, in use, substantially perpendicular to said aperture axis 180 of the aperture 118 and said longitudinal axis 408 of the connector 400. In some embodiments, first and second engaging means 204 are arranged at respective first and second sides of the second cover part 200 to engage with respective first and second features 412 of the connector 400.

The opening 202 of the second cover part 200 is arranged to receive the member 106 of the first cover part 100. The opening 202 may be sized and shaped to match a profile, such as a thickness and width, of the member 106 so that the member 106 may be received in the opening 202 in a close sliding fit. The aperture 118 is arranged about the member 106 such that when the cover system 300 is assembled with the electrical connector 400 and a locking means (not shown) is received by said aperture 118, disengagement of the engaging means from the electrical connector 400 is substantially prevented. In some embodiments, this may be achieved by a position of the aperture 118 about the member 106 being such that a distance 130 between the aperture 118 and an upper surface of the body portion 102 is less than a distance 230 over which the engaging means 204 is arranged to maintain engagement with the feature 412 of the connector. The distance 230 may be defined by a length of the open ended slot 204, such as may be defined by a length of the legs 206*a*, 206*b* in some embodiments. That is, the distance 130 between the aperture 118 and the upper surface of the body portion 102 may define a maximum distance of movement of the second cover part 200 in the axis 410 when locked, which is less than the distance 230 required to disengage the engaging means 204 from the one or more features 412 of the connector 400.

Additionally or alternatively, said substantial prevention of disengagement may be achieved by providing the aperture 118 on the member 106 and the engaging means 204 on the second cover part 200 such that when the second cover part 200 is fitted to the first cover part 100 and the connector 400, the aperture axis 180 and the slot axis or axes 240*a*, 240*b* are substantially orthogonal to each other. To remove the first cover part 100 from the socket 406 of the connector, it must be moved in a direction away from the socket, along the longitudinal axis 408 and aperture axis 180. The engaging means 204, however, substantially prevents movement of the first cover part 100 at least along the axes 408, 180. When the locking means is received through the aperture 118, the locking means substantially prevents movement of the second cover part 200, or at least the engaging means 204, at least in a direction along axes 240*a*, 240*b*, 410. In this way, the axes 180, 240 interlock to prevent release when a locking means is received through the aperture 118 of the member 106. That is, the first cover part 100 and second cover part 200 mutually lock together when fitted to the connector 400 when a locking means is received though the aperture 118.

The first cover part 100 therefore provides the seal about at least one of the terminals 402, 404 of the connector 400 and the second cover part 200 provides locking of the first cover part 100 to the connector 400. Due, at least partially, to the positioning of the aperture 118 and the engaging means 204 and their respective axes 180, 240*a*, 240*b*, the first cover part 100 cannot be moved in a direction away from the connector 400 along the longitudinal axis 408, when the second cover part is fitted about the first cover part and the engaging means is connected with the connector 400. Also due, at least partially, to the positioning of the aperture 118 and the engaging means 204 and their respective axes 180, 240*a*, 240*b*, the second cover part 200 cannot be moved in a direction away from the connector 400 along the axis 410 of the connector 400 when a locking means is received through the aperture 118. In this way, the first and second cover parts 100, 200 are able to mutually lock together when fitted to the connector 400.

In some embodiments, the second cover part 200 comprises at least one locating feature 215. The locating feature 215 may at least partially help to align the second cover part 200 about the first cover part 100 and the electrical connector 400. The locating feature 215 may be arranged to correspond with a locating feature on the connector 400. In the embodiment illustrated in FIG. 2, the locating feature 215 comprises a recess on an internal surface of a top face of the second cover part 200. The recess may be shaped to complement a corresponding protrusion 415 on connector 400. The second cover part 200 may comprise one or more cut-outs 220 for accommodating one or more bolt heads in the connector 400. The one or more cut-outs 220 may additionally or alternatively provide a locating feature function, for at least partially aiding with alignment of the second cover part 200 about the first cover part 100 and the electrical connector 400.

In some embodiments, a friction fit or an interference fit may be provided between the first cover part 100 and the second cover part 200. In some embodiments, this is achieved by the second cover part 200 comprising an end face 225. The end face 225 is arranged to be coplanar with an end face 125 of the first cover part 100 when the second cover part 200 is fitted about the first cover part 100. In this way, a flush fitting is provided between the first cover part 100 and the second cover part 200 to prevent movement of the cover parts 100, 200.

In some embodiments, the cover system 300 may be provided with a wedge clip feature, enabling the first and second cover parts 100, 200 to lock gently together.

In some embodiments, the cover system 300 may comprise means (not shown) for allowing activation of a voltage interlock loop, such as a voltage interlock loop (VIL) of the electrical connector 400 when at least the first cover part 100 of the cover system 300 is fitted to the electrical connector 400. The means for allowing VIL activation may be provided by the first cover part 100. The means may comprise an internal connection in the first cover part 100, such as on an internal surface of the end face 125, for bridging a connection between the terminals 402, 404 of the electrical connector 400. Such means may enable diagnostic checks to be run whilst the terminals 402, 404 are sealed off by said sealing means 104 of the first cover part 100.

The electrical connector 400 may comprise a socket key on an underside of the electrical connector 400. In some embodiments, the cover system 300 may be arranged so that when the cover system 300 is fitted to the electrical connector 400, the socket key remains uncovered. In some embodiments, this may be achieved by the second cover part 200 being arranged to fit over a top side of the electrical connector 400. The connector 400 may be arranged so as to prevent the second cover part 200 from being fitted upside down on the electrical connector 400, i.e. from fitting over the underside of the electrical connector 400. The electrical connector 400 may comprise a locating feature to prevent to prevent the second cover part 200 from being fitted upside down on the connector 400. The locating feature may be the same feature 412 with which the engaging means 204 of the second cover part 200 is arranged to engage. The feature 412 may be offset in a horizontal plane to indicate to a user a correct orientation for the second cover part 200. The feature 412 may comprise one or more lugs.

Figure 5B:
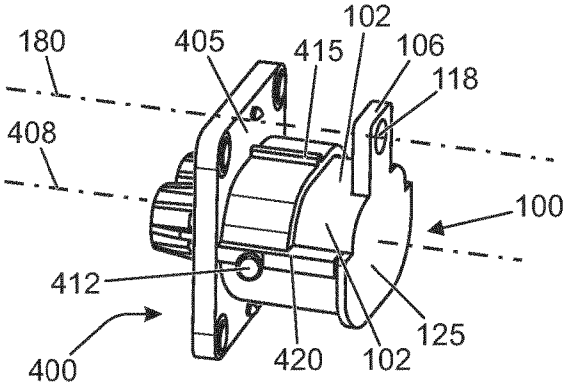
FIGS. 5A to 5D show a method of fitting the first and second cover parts of FIGS. 1 to 3 to an electrical connector, according to an embodiment of the invention.
Figure 5D:
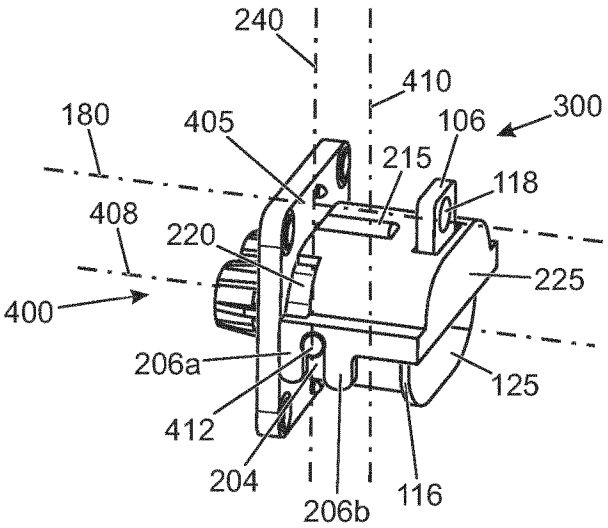
Figure 5A:
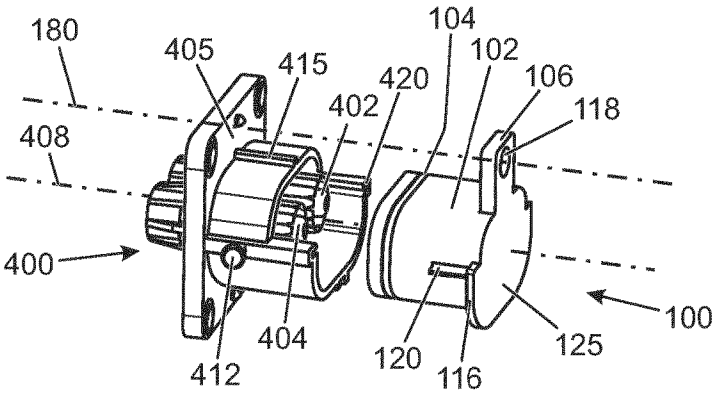

FIGS. 5A to 5D show a method for at least temporarily preventing access to one or more terminals of an electrical connector 400 according to embodiments of the invention. With reference to FIGS. 5A and 5B, the method comprises sealing the first cover part 100 about the one or more terminals 402, 404 of the electrical connector 400. This may comprise first translating said first cover part 100 along the longitudinal axis 408 of the electrical connector 400, towards the electrical connector 400, to engage the first cover part 100 with the connector 400. In some embodiments, the first cover part 100 comprises a body portion 102. The method may therefore, in some embodiments, such as the embodiment illustrated in FIG. 5B, comprise, prior to said sealing, inserting the body portion 102 of a first cover part 100 at least partially within the female portion or socket 406 of the electrical connector 400. A stop 116 may be provided on the first cover part 100 to prevent over insertion of the body part 102. The method may comprise aligning the first cover part 100 with the connector 400 by aligning one or more locating means, such as one or more flanges 120, of the first cover part 100 with one or more corresponding features, such as grooves 420, of the connector 400. When the first cover part 100 is engaged with the connector 400, said aperture axis 180 may be substantially parallel to the longitudinal axis 408 of the connector 400 and substantially orthogonal to the axis 410 of the connector.

Figure 5C:
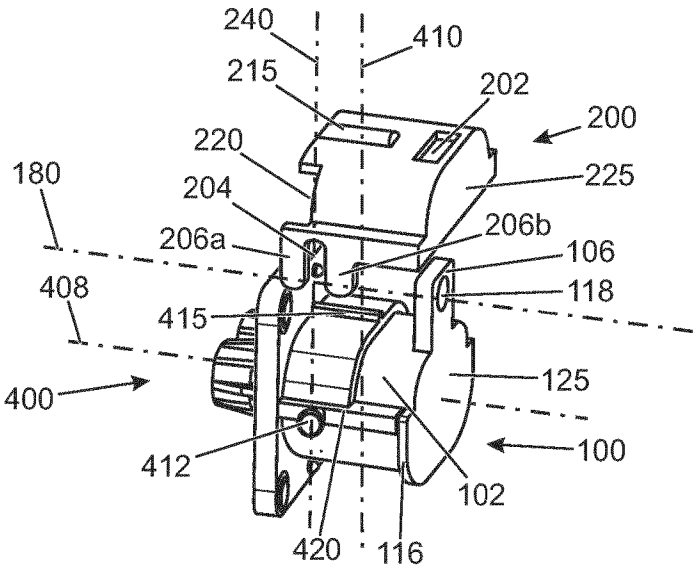

With particular reference to FIG. 5C, the second cover part 200 is positioned over the first cover part 100 so that the member 106 of the first cover part 100 is received through the opening 202 of the second cover part 200. After said sealing, the second cover part 200 is moved over at least a portion of the first cover part 100 so that the second cover part 200 is arranged about at least a portion of the first cover part 100 and at least a portion of the connector 400, as shown in the embodiment illustrated in FIG. 5D. Said moving the second cover part 200 may, in some embodiments, comprise moving the second cover part 200 along the axis 410 of the connector 400, which axis 410 is substantially orthogonal to the longitudinal axis 408 of the electrical connector 400 and the aperture axis 180 of the first cover part 100 received therein. The method may comprise aligning the second cover part 100 with the connector 400 by aligning one or more locating features 215 of the second cover part 200 with one or more corresponding features, such as the protrusion 415, of the connector 400.

The engaging means 204 of the second cover part 200 are engaged with the electrical connector 400, such as with the feature 412, to at least partially retain the second cover part 200 about at least a portion of the first cover part 100 and at least part of the electrical connector 400. When the second cover part 200 is engaged with the connector 400, said slot axes 240*a*, 240*b* are substantially orthogonal to the aperture axis 180 of the first cover part 100. When the second cover part 200 is engaged with the connector 400 the slot axes 240*a*, 240*b*, may be substantially parallel to the axis 410 of the connector 400 and substantially orthogonal to the longitudinal axis 408 of the connector 400.

A locking means, such as a padlock or a cable tie, may be inserted through the aperture 118 once the first and second cover parts 100, 200 are fitted to the connector 400. As discussed above, the aperture 118 of the member 106 is arranged on the member 106 such that when the first and second cover parts 100, 200 are assembled with the electrical connector 400 and a locking means is received by said aperture 118, disengagement of the engaging means 204 from the electrical connector 400 is substantially prevented. This may be achieved by positioning the aperture 118 on the member 106 such that a length 130 between the aperture 118 and the body portion 102 is less than a length 230 over which length 230 the engaging means may maintain engagement with the feature 412 of the connector. The length 230 may be defined by a length of the open ended slot 204, such as may be defined by a length of the legs 206*a*, 206*b*.

Additionally or alternatively, said substantial prevention of disengagement may be achieved by providing the aperture 118 on the member 106 and the engaging feature 204 on the second cover part 200 such that when the second cover part 200 is fitted to the first cover part 100 and the connector 400, the aperture axis 180 and the slot axis or axes 240*a*, 240*b* are substantially orthogonal to each other. To remove the first cover part 100 from the socket 406 of the connector 400, it must be moved in a direction away from the socket, along the longitudinal axis 408 and aperture axis 180. The engaging means 204, however, substantially prevents movement of the first cover part 100 at least along the axes 408, 180. When the locking means is received through the aperture 118, the locking means substantially prevents movement of the second cover part 200, or at least the engaging means 204, at least in a direction along axes 240*a*, 240*b*, 410. In this way, the axes 180, 240 interlock to prevent release when a locking means is received through the aperture 118 of the member 106. That is, the first cover part 100 and second cover part 200 mutually lock together when fitted to the connector 400 when a locking means is received though the aperture 118.

The first cover part 100 therefore provides the seal about at least one of the terminals 402, 404 of the connector 400 and the second cover part 200 provides locking of the first cover part 100 to the connector 400. Due, at least partially, to the positioning of the aperture 118 and the engaging means 204 and their respective axes 180, 240*a*, 240*b*, the first cover part 100 cannot be moved in a direction away from the connector 400 along the longitudinal axis 408, when the second cover part is fitted about the first cover part and the engaging means is connected with the connector 400. Also due, at least partially, to the positioning of the aperture 118 and the engaging means 204 and their respective axes 180, 240*a*, 240*b*, the second cover part 200 cannot be moved in a direction away from the connector 400 along the axis 410 of the connector 400 when a locking means is received through the aperture 118. In this way, the first and second cover parts 100, 200 are able to mutually lock together when fitted to the connector 400.

Once the cover system 300 is fitted to the connector 400, any appropriate operations, such as servicing, transporting or storing a battery pack, to which the connector 400 is connected, may be carried out safely. After such operations, if it is desired to regain access to the connector 400, the cover system 300 may be disassembled from the connector 400.

To disassemble the cover system 300 from the connector 400, any locking means received by the aperture 118 must first be removed. The engaging means 204 of the second cover part 200 may be disengaged from the connector 400 and the second cover part may be moved away from the connector 400 in a direction along the slot axes 240*a*, 240*b* and axis 410 of the connector. Once the second cover part 200 has been disengaged and moved, the first cover part 100 may then be moved away from the connector 400 in a direction along the aperture axis 180 and the longitudinal axis 408 of the connector 400. The first cover part 100 and second cover part 200 may be reused multiple times.

It will be appreciated that embodiments of the present invention can be realised in the form of hardware, software or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are embodiments of machine-readable storage that are suitable for storing a program or programs that, when executed, implement embodiments of the present invention. Accordingly, embodiments provide a program comprising code for implementing a system or method as claimed in any claim herein and a machine readable storage storing such a program. Still further, embodiments of the present invention may be conveyed electronically via any medium such as a communication signal carried over a wired or wireless connection and embodiments suitably encompass the same All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed. The claims should not be construed to cover merely the foregoing embodiments, but also any embodiments which fall within the scope of the claims.

The invention claimed is:

1. A cover system for at least temporarily preventing access to one or more terminals of an electrical connector, the system comprising:

a first cover part comprising:

a seal for sealing the first cover part about the one or more terminals of the electrical connector; and a member comprising an aperture for receiving a lock; and a second cover part receivable about at least a portion of the first cover part and at least part of the electrical connector, the second cover part comprising:

engaging means for engaging with the electrical connector to at least partially retain the second cover part about the first cover part and at least part of the electrical connector; and an opening for receiving the member of the first cover part, wherein the aperture is arranged such that when the cover system is assembled with the electrical connector and the lock is received by said aperture, disengagement of the engaging means from the electrical connector is substantially prevented.

2. The cover system of claim 1, wherein the aperture is arranged on the member and the engaging means are arranged on the second cover part such that when the first cover part and the second cover part are fitted to the electrical connector, an aperture axis through the aperture is substantially orthogonal to an axis or axes of the engaging means.

3. The cover system of claim 1, wherein the aperture is arranged on the member and the engaging means is arranged on the second cover part, such that a distance along the member where aperture is located is of a shorter length than a length over which the engaging means may maintain engagement with the electrical connector.

4. The cover system of claim 1, wherein the first cover part is at least partially receivable about at least one of the one or more terminals of the electrical connector along a longitudinal axis of the electrical connector.

5. The cover system of claim 4, wherein the second cover part is receivable about at least a portion of the first cover part and at least part of the electrical connector along an axis substantially perpendicular to the longitudinal axis of the electrical connector.

6. The cover system of claim 1, wherein said engaging means comprises a first open ended slot correspondingly shaped to engage with a first lug on the electrical connector.

7. The cover system of claim 6, wherein the engaging means comprises a second open ended slot correspondingly shaped to engage with a second lug on the electrical connector, wherein the first and second lugs on the electrical connector are arranged at opposing sides of the electrical connector.

8. The cover system of claim 6, wherein said open ended slot or slots are each defined by a pair of legs depending from a main body portion of the second cover part.

9. The cover system of claim 1, wherein the engaging means is engageable with the electrical connector by a snap fit mechanism.

10. The cover system of claim 1, wherein the first cover part comprises a body portion, which body portion is at least partially insertable within a female portion of the electrical connector.

11. The cover system of claim 10, wherein the first cover part comprises at least one stop for preventing over insertion of the body portion within the female portion of the electrical connector.

12. The cover system of claim 1, wherein the first cover part comprises at least one locating feature for at least partially aiding alignment of the first cover part with the electrical connector.

13. The cover system of claim 1, wherein the second cover part comprises at least one locating feature for at least partially aiding alignment of the second cover part about the first cover part and the electrical connector.

14. The cover system of claim 1, wherein the sealing means comprises at least one O-ring.

15. The cover system of claim 1, wherein the seal comprises a labyrinth seal.

16. A method of at least temporarily preventing access to one or more terminals of an electrical connector, the method comprising:

sealing a first cover part about the one or more terminals of the electrical connector;

positioning a second cover part over the first cover part so that a member portion of the first cover part is received through an opening of the second cover part;

moving the second cover part over at least a portion of the first cover part after the first cover part has been sealed to the one or more terminals of the electrical connector; and engaging an engaging means of the second cover part with the electrical connector to at least partially retain the second cover part about at least a portion of the first cover part and at least part of the electrical connector, wherein the member portion comprises an aperture for receiving a lock, and wherein the aperture is arranged such that when the first and second cover parts are assembled with the electrical connector and the lock is received by said aperture, disengagement of the engaging means from the electrical connector is substantially prevented.

17. The method of claim 16 further comprising translating said first cover part about the one or more terminals of the electrical connector along a longitudinal axis of the electrical connector.

18. The method of claim 17, wherein said moving the second cover part comprises moving the second cover part along an axis substantially orthogonal to the longitudinal axis of the electrical connector.

19. The method of claim 16 further comprising inserting a body portion of a first cover part at least partially within a female portion of the electrical connector.

20. The method of claim 16 further comprising applying the lock through the aperture of the member portion.

* * * * *